US006022098A

United States Patent [19]

Fujii

[11] Patent Number: 6,022,098

[45] Date of Patent: Feb. 8, 2000

[54] INK-JET RECORDER

[75] Inventor: Masahiko Fujii, Ebina, Japan

[73] Assignee: Fuji Xerox Co., Ltd., Tokyo, Japan

[21] Appl. No.: 08/692,481

[22] Filed: Aug. 6, 1996

[30] Foreign Application Priority Data

| | | | |
|---|---|---|---|
| Aug. 10, 1995 | [JP] | Japan | 7-204462 |
| Aug. 10, 1995 | [JP] | Japan | 7-204463 |
| Aug. 10, 1995 | [JP] | Japan | 7-204464 |

[51] Int. Cl.[7] ..... B41J 2/05

[52] U.S. Cl. ..... 347/56

[58] Field of Search ..... 347/56, 54, 20, 347/1, 40, 42, 43, 61, 62, 67, 15, 65

[56] References Cited

U.S. PATENT DOCUMENTS

| | | | |
|---|---|---|---|
| 4,380,771 | 4/1983 | Takatori | 346/140 R |
| 4,463,359 | 7/1984 | Ayata et al. | 347/56 |
| 4,746,935 | 5/1988 | Allen | 346/140 R |
| 5,055,859 | 10/1991 | Wakabayashi et al. | 347/209 |
| 5,113,203 | 5/1992 | Takagi | 347/62 |
| 5,133,203 | 7/1992 | Takagi et al. | 347/62 |
| 5,159,354 | 10/1992 | Hirasawa et al. | 347/65 |
| 5,463,412 | 10/1995 | Matsuda | 347/43 |
| 5,777,640 | 7/1998 | Shioya et al. | 347/15 |

FOREIGN PATENT DOCUMENTS

| | | | |
|---|---|---|---|
| 0 551 521 A1 | 7/1993 | European Pat. Off. . | |
| 0 569 156 A2 | 11/1993 | European Pat. Off. . | |
| 613781 | 7/1994 | European Pat. Off. | 347/62 |
| 0 613 781 A1 | 9/1994 | European Pat. Off. . | |
| 57-87960 | 6/1982 | Japan . | |
| 1-281945 | 11/1989 | Japan | 347/43 |
| 401281945 | 11/1989 | Japan | 347/43 |
| 3-224743 | 10/1991 | Japan . | |
| 4-67954 | 3/1992 | Japan | 347/47 |
| 5-155020 | 6/1993 | Japan . | |

OTHER PUBLICATIONS

Patent Abstracts of Japan, vol. 017, No. 576 (M–1499) Oct. 20, 1993 & JP 05 169681 A (Canon Inc.) Jul. 9, 1993.

Patent Abstracts of Japan, vol. 016, No. 477 (M–1320), Oct. 5, 1992 & JP 04 173249 A (Fuji Xerox Co Ltd), Jun. 19, 1992.

Physics vol. 2, Hans C. Ohanian. pp. 631–633, 1985.

*Primary Examiner*—John Barlow
*Assistant Examiner*—Michael Brooke
*Attorney, Agent, or Firm*—Oliff & Berridge, PLC

[57] ABSTRACT

A polycrystalline silicon layer which serves as a heating resistor is laid on a Si substrate, whereby a heating area 25 and a low-resistance area 26 are formed. In this event, the area of the heating area 25 is set according to the physical properties of ink squirted from a corresponding nozzle. As a result, the amount of ink droplet to be squirted becomes an optimum value, and the quality of an image is improved. Further, the heating area 25 is formed such that the resistance of the heating area becomes larger as the area of the heating area becomes smaller. Eventually, the amounts of energy per unit area of the heating areas become equal to each other, and ink-jet nozzles can be actuated using the same drive pulse.

15 Claims, 8 Drawing Sheets

FIG. 6

| HEAD | HEATING RESISTOR | INK | COLOR | VISCOSITY (cp) | SURFACE TENSION (dyne/cm) | INK DROPLET AMOUNT (pl) |
|---|---|---|---|---|---|---|
| A | 1 | INK k1 | BLACK | 2.2 | 43 | 90 |
| B | 2 | INK y | Y | 2.7 | 35 | 54 |
| B | 3 | INK m | M | 2.9 | 38 | 50 |
| B | 4 | INK c | C | 2.7 | 38 | 60 |

FIG. 7 *Prior Art*

| INK | HEATING REGION | | | BUBBLE FORMING REGION AREA ($\mu m^2$) | CHANNEL WIDTH ($\mu m$) | AMOUNT OF INK DROPLET BE SQUIRTED (pl) | SPEED OF SQUIRTED INK (m/s) |
|---|---|---|---|---|---|---|---|
| | LENGTH ($\mu m$) | WIDTH ($\mu m$) | AREA ($\mu m^2$) | | | | |
| k1 | 116 | 50 | 5800 | 5800 | 54 | 90 | 12.6 |
| y | 116 | 50 | 5800 | 5800 | 46 | 58 | 13.8 |
| m | 116 | 50 | 5800 | 5800 | 46 | 59 | 14.0 |
| c | 116 | 50 | 5800 | 5800 | 46 | 58 | 13.7 |

FIG. 8

| HEAD | HEATING RESISTOR | HEATING REGION | | BUBBLE FORMING AREA | | | CHANNEL WIDTH ($\mu m$) |
|---|---|---|---|---|---|---|---|
| | | LENGTH ($\mu m$) | WIDTH ($\mu m$) | LENGTH ($\mu m$) | WIDTH ($\mu m$) | AREA ($\mu m^2$) | |
| A | 1 | 117 | 50 | 116 | 50 | 5800 | 54 |
| B | 2 | 117 | 50 | 117 | 43 | 5031 | 49 |
| B | 3 | 117 | 50 | 117 | 43 | 5031 | 49 |
| B | 4 | 117 | 50 | 114 | 43 | 5130 | 51 |

FIG. 9

| HEAD | HEATING RESISTOR | INK | AMOUNT OF INK DROPLET TO BE SQUIRTED (pl) | SPEED OF SQUIRTED BUBBLE (m/s) |
|---|---|---|---|---|
| A | 1 | k1 | 90 | 12.6 |
| B | 2 | y | 54 | 12.4 |
| B | 3 | m | 50 | 12.2 |
| B | 4 | c | 60 | 12.7 |

FIG. 10

| HEAD | HEATING RESISTOR | HEATING REGION | | | | AREA OF BUBBLE FORMING REGION ($\mu m^2$) | CHANNEL WIDTH ($\mu m$) | ENERGY PER UNIT AREA (RELATIVE VALUE) |
|---|---|---|---|---|---|---|---|---|
| | | LENGTH ($\mu m$) | WIDTH ($\mu m$) | AREA ($\mu m^2$) | ASPECT RATIO | | | |
| A | 1 | 116 | 50 | 5800 | 2.32 | 5800 | 54 | 1.00 |
| B | 2 | 117 | 43 | 5031 | 2.72 | 5031 | 49 | 0.98 |
| B | 3 | 117 | 43 | 5031 | 2.72 | 5031 | 49 | 0.98 |
| B | 4 | 114 | 43 | 5130 | 2.53 | 5130 | 51 | 1.04 |

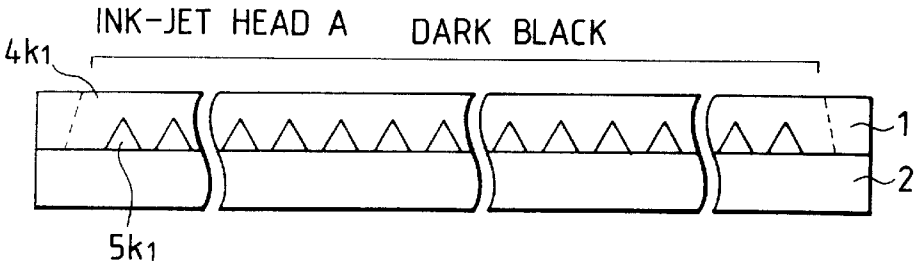
FIG. 11A
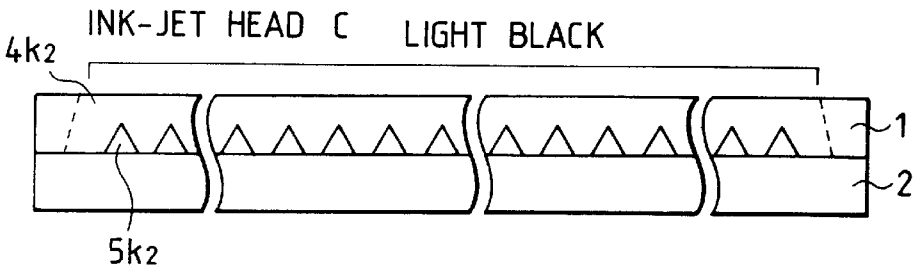
FIG. 11B
FIG. 12
| HEAD | HEATING RESISTOR | INK | HEATING REGION | | | | CHANNEL WIDTH (μm) | HEAT RESISTANCE (Ω/□) | RESISTANCE (Ω) |
|---|---|---|---|---|---|---|---|---|---|
| | | | LENGTH (μm) | WIDTH (μm) | AREA (μm²) | ASPECT RATIO | | | |
| A | 1 | k1 | 116 | 50 | 5800 | 2.32 | 54 | 45 | 104.4 |
| C | 5 | k2 | 109 | 47 | 5123 | 2.32 | 51 | 51 | 118.3 |

INK-JET RECORDER

BACKGROUND OF THE INVENTION

1. Field of the Invention

The present invention relates to an ink-jet recorder which carries out a recording operation by squirting an ink droplet from a nozzle by means of the pressure of a bubble resulting from generation of heat by a heating element. Particularly, the present invention relates to an ink-jet recorder having nozzles for squirting ink having different colors or concentrations.

2. Description of the Related Art

Commercialization of an ink-jet recording system is proceeding for reasons that the ink-jet recording system can perform high-speed recording without substantial noise, can produce print on ordinary paper directly, and can be reduced in size because it does not require fixing processing.

The ink-jet recording system comprises a system which uses an electromechanical transducer as means for squirting an ink droplet from a nozzle, and which squirts an ink droplet by means of movement resulting from the mechanical deformation of the electromechanical transducer corresponding to an input signal. The ink-jet recording system further comprises a so-called thermal ink-jet system which uses an electro-thermal transducer (a heating resistor), and which squirts an ink droplet by means of the pressure of a bubble developed on the heating element when the heating element produces heat as a result of receipt of an applied voltage pulse.

FIGS. 14A to 14C show one example of a conventional thermal ink-jet head. FIG. 14A is a cross-sectional view of the thermal ink-jet head which is taken in the axial direction of a channel; FIG. 14B is a plan view of the thermal ink-jet head taken along line B—B shown in FIG. 14A; and FIG. 14C is a front view of the thermal ink-jet head as viewed from a nozzle. In the drawings, reference numeral 1 designates a channel substrate, 2 designates a heating resistor substrate, 3 is a channel, 4 is a common liquid chamber, 5 is a nozzle, 6 is an unetched area, 7 is a heating resistor, 8 is an insulating layer, 9 is a thick-film insulating layer, 10 is a first indentation, 11 is a second indentation, 12 is a partition, 13 is an ink droplet, and 14 is an ink feed port. FIGS. 14A to 14C show a thermal ink-jet head disclosed in Unexamined Japanese Patent Application No. Hei-5(1993)-155020 as one example.

The channel 3 and the common liquid chamber 4 are formed in the channel substrate 1 by anisotropic etching, and an opening of the channel 3 acts as the nozzle 5. The channels 3 are formed with pitches Pn, and they are separated from each other by the partitions 12. The unetched area 6 is present between the channel 3 and the common liquid chamber 4. The common liquid chamber 4 is formed so as to pass through the channel substrate 1, and a through-hole of the common liquid chamber serves as the ink feed port 14.

The heating resistors 7 are formed in the heating resistor substrate 2, and electrodes (not shown) and protective films (not shown) for feeding a drive signal to the heating resistors 7 are formed on the heating resistor substrate 2. The insulating layer 8 and the thick-film insulating layer 9 are further formed on the heating resistor substrate 2. The insulating layer 8 and the thick-film insulating layer 9 are removed from the top of the heating resistor 7, so that the first indentation 10 is formed. The second indentation 11 is formed in the thick-film insulating layer 9 in order to connect the channel 3 to the common liquid chamber 4.

These two substrates, i.e., the channel substrate 1 and the heating resistor substrate 2 are cemented together, and they are cut into individual head chips, whereby a thermal ink-jet head is manufactured.

The ink fed from the ink feed port 14 to the common liquid chamber 4 is introduced into the channel 3 which is an ink flow path via the second indentation 11 formed in the thick-film insulating layer 9. The ink is squirted from the nozzle 5 to a recording medium in the form of the ink droplet 13 by means of the pressure of a bubble which is formed in the first indentation 10 as a result of generation of heat by the heating resistor 7.

FIG. 15 is a detailed cross-sectional view of a surrounding area of a heating resistor of one example of a conventional ink-jet recording head, and FIG. 16 is a top view of the surrounding area of the heating resistor shown in FIG. 15. In the drawings, the same elements as those shown in FIG. 14 are assigned the same reference numerals, and their explanations will be omitted here. Reference numeral 21 designates a common electrode, 22 designates an individual electrode, 23 designates a Ta layer, 24 designates a $Si_3N_4$ layer, 25 designates a heating region, 26 designates a low-resistance area, 27 designates a first glass layer, 28 designates a second glass layer, 29 designates a $SiO_2$ layer, 30 designates a Si substrate, and 31 and 32 designate through-holes.

After the $SiO_2$ layer 29, which acts as a thermal storage layer, has been formed on the Si substrate 30, a polycrystalline silicon layer which acts as a heating resistor is formed on the $SiO_2$ layer 29. The polycrystalline silicon layer is of high resistance, and hence it is necessary to reduce the resistance to a value suitable for the heating resistor. In order to cause only a predetermined area which produces a bubble to generate heat, it is necessary to form the low-resistance area 26 by reducing the resistance of an area other than the area of the polycrystalline layer in which the heating area 25 is to be formed, that is, the resistance of an area of the polycrystalline silicon layer which becomes electrodes extending from the heating electrode 25 to the common electrode 21 and the individual electrode 22. Impurity ions (P or As ions) are implanted into that area (i.e., ion implantation) in order to reduce the resistance of the area.

In FIG. 16, after having been laid, the polycrystalline silicon is patterned, so that a polycrystalline silicon layer is formed. The resistance of the polycrystalline silicon layer is reduced to a suitable value by ion implantation, whereby the heating area 25 is formed. In order to connect the heating area 25 to the common electrode 21 and the individual electrode 22, the resistance of the polycrystalline silicon layer is further reduced by carrying out the ion implantation again. As a result, the low-resistance area 26 is formed.

The first glass layer 27 which serves as an interlayer insulating film is formed over the low-resistance area 26. The through-holes 31, 32 are formed in this first glass layer 27 so as to electrically connect the low-resistance area 26 to the common electrode 21 and the individual electrode 22. Subsequently, the $Si_3N_4$ layer 24 which serves as an insulating layer and the Ta layer 23 which serves as a protective metal layer are formed, in that order, on the heating area 25. To provide electrical energy to the heating area 25, the common electrode 21 and the individual electrode 22 which are formed from aluminum are patterned on the first glass layer. At this time, the common electrode 21 and the individual electrode 22 are connected to the polycrystalline silicon layer 26 via the through-holes 31 and 32 formed in the first glass layer 27. Then, the second glass layer 28, the insulating layer 8, and the thick-film insulating layer 9 are formed on the substrate in that order.

In the thermal ink-jet head manufactured in the manner as previously described, the size of the ink droplet squirted from the nozzle depends on so-called flow path parameters, that is, the size and location of the heating resistor and the length and width of the flow path, as well as the physical properties of the ink. Therefore, in the case of an ink-jet recorder which records a color image using a plurality of ink-jet heads for squirting ink having different colors, or in the case of an ink-jet recording system which reproduces gradations using a plurality of ink-jet recorders for squirting ink having different concentrations, it is necessary to change the flow path parameters of the thermal ink-jet head in order to cause an appropriate quantity of ink droplet to be squirted.

Unexamined Japanese Patent Application No. Sho-57 (1982)-87960 discloses a longitudinally mounted ink-jet head, wherein the size of a heating element is changed in order to correct the difference between the amounts of ink droplet to be squirted due to the difference in ink pressures which nozzles receive. As disclosed in that application, it is most effective to change the size of the heating resistor of the flow path parameters in order to change the size of the ink droplet.

However, if the heating resistors are different from each other in size, the energy required to produce a bubble on the heating resistor and the resistance value of the heating resistor become different. As a result, it is necessary to change the voltage value and the pulse width of the voltage pulse used to actuate the ink-jet head. Accordingly, it is necessary to provide the ink-jet recorder with a high-speed control circuit which has a voltage corresponding to each of the nozzles (the heating resistor) and ink-jet heads, or a plurality of power supplies for feeding a plurality of voltages, which adds to the cost of the ink-jet recorder.

It may be conceived that the pulse width of the voltage pulse is changed while the voltage is maintained. FIG. 5 shows the relationship between the voltage applied to the heating resistor and the amount of ink droplet when the width of the applied voltage pulse is changed. In the drawing, reference numeral 41 designates a flat region. Curves "a" to "d" designate pulse widths of 2.5 $\mu$s, 3 $\mu$s, 3.5 V $\mu$s, and 4 $\mu$s, respectively.

As designated by the curves "a" and "b", if the pulse having a relatively narrower pulse width is applied to the heating resistor, the curves have the flat region 41 in which the amount of ink droplet to be squirted does not depend on the applied voltage. To make the amount of ink droplet to be squirted less susceptible to the influence of variations in the supply voltage, it is desirable to set the drive voltage of the ink-jet recorder in that flat region 41. If the pulse width becomes wider, the curves do not have the flat region 41 in which the size of an ink droplet to be squirted is not affected by voltage variations, as designated by the curves "c" and "d". If the supply voltage changes due to environmental conditions, or the like, the size of ink-droplet to be squirted may greatly change.

Conversely, if the pulse width becomes excessively narrow, the bubble will not arise. In short, the layer formed on the heating resistor is made up of a plurality of layers in order to protect the heating resistor from cavitation damage resulting from the disappearance of the bubbler and hence that layer has a certain degree of thickness. Because of the heat capacity of that layer, temperature variations in the surface which is in contact with the ink cannot respond to the voltage pulse. As a result, the temperature of that surface fails to reach the temperature necessary to produce a bubble, and hence the bubble does not arise, which in turn prevents the squirt of the ink droplet. As described above, it is desirable to actuate the ink-jet nozzle head using the optimum pulse width in order to stably squirt the ink droplet. Hence, it is not desirable to change the pulse width for each ink-jet head. The change of the pulse width renders the drive circuit complicated.

Further, it is conceived that one ink-jet head is divided in such a way as to be assigned to ink of a plurality of colors in order to reduce the number of ink-jet heads in the ink-jet recorder. In this case, it is still further undesirable to feed voltage pulses having different amplitudes and widths to heating resistors for the ink of different colors in one head in view of an increase in the number of wires and the configuration of the drive circuit.

If the heating resistors which require different energies are actuated by the same voltage pulse (the same voltage and the same pulse width), the following problems will arise. If the pulse conditions are set so as to provide sufficient energy to the heating resistors which require high energy, the energy conditions become much excessive for the heating resistors which require low energy. As a result, the life of the heating resistors becomes shortened, or changes in the characteristics of the heating resistors due to the scorch of the ink caused when the ink is squirted are accelerated. On the other hand, if the pulse conditions are set so as to be suitable for the heating resistors that require low energy, the amount of ink droplet squirted by the heating resistors that require high energy may become apt to be affected by voltage variations, or the heating resistors may not squirt ink because of burns of the ink adhered to the heating resistors as a result of the squirting of the ink for a long period of time.

Unexamined Japanese Patent Application No. Hei-3 (1991)-224743 discloses a bubble generating area which is smaller than a heating area. As will be described later, it becomes possible to reduce the amount of ink droplet as a result of reductions in the size of the bubble generating area. However, the use of such a configuration in the above described patent application is only intended to reduce cavitation damage. The above described patent application fails to describe or teach the acquisition of a suitable amount of ink droplet with regard to the ink of a plurality of colors or concentrations as previously described.

SUMMARY OF THE INVENTION

The present invention has been conceived in view of the above described problems with the prior art, and therefore an object of the present invention is to provide an ink-jet recorder which squirts ink droplets having different colors or concentrations and is improved so as to produce a higher-quality image by controlling the amount of ink droplet to be squirted to an appropriate level while the same electrical driving conditions of nozzles are maintained.

According to a first aspect of the present invention, there is provided an ink-jet recorder which carries out a printing operation by squirting an ink droplet from one or more nozzles provided for each set of colors or concentrations by means of the heat generated by a heating resistor, the improvement being characterized by the fact that the heating resistor has a heating area corresponding to each color or concentration, and the resistance of the heating area of the heating resistor is increased with the smaller heating area.

According to a second aspect of the present invention, there is provided an ink-jet recorder which carries out a printing operation by squirting ink droplets from one or more nozzles provided for each set of colors or concentrations by means of the heat generated by a heating resistor, the improvement being characterized by the fact that the heating resistor has a heating area corresponding to each color or concentration, and an aspect ratio AR=L/W of the heating area is increased with the smaller heating area on the assumption that the length of the heating area of the heating resistor in the direction of a flow path is L, and that the width of the heating area of the heating resistor in the direction in which the heating resistors are arranged is W.

According to a third aspect of the present invention, the ink-jet recorder as defined in the first or second aspect is characterized by the fact that the nozzles provided for each set of colors or concentrations are disposed on a plurality of ink-jet recording heads.

According to a fourth aspect of the present invention, the ink-jet recorder as defined in the first or second aspect is characterized by the fact that the nozzles provided for each set of colors or concentrations is disposed in one ink-jet recording head.

According to a fifth aspect of the present invention, the ink-jet recorder as defined in the first or second aspect is characterized by comprising drive means for actuating the nozzles provided for each set of colors or concentrations under substantially the same electrical conditions.

According to a sixth aspect of the present invention, the ink-jet recorder as defined in the fifth aspect is characterized by the fact that the drive means actuates the nozzles on substantially the same voltage and with substantially the same pulse width.

According to the ink-jet recorder as defined in the first aspect of the present invention, the heating area is set for each of a plurality of colors or concentrations. As a result, if it is necessary to change the amount of ink droplet to be squirted for reasons of the physical properties of the ink, it is possible to change the amount of ink droplet to be squirted by setting the heating area. At this time, it is possible to ensure the equal amount of supplied energy per unit area by increasing the resistance of the heating area of the heating resistor with the smaller heating area. Like the ink-jet recorder as defined in the fourth aspect of the present invention, the heating resistor which squirts a different amount of ink droplet can be actuated under substantially the same electrical conditions. Particularly, like the ink-jet generating resistor as defined in the fifth aspect of the present invention, the nozzle can be actuated on substantially the same voltage and with substantially the same pulse width.

According to the ink-jet recorder as defined in the first aspect of the present invention, the heating area of the heating resistor is set for each set of colors or concentrations. As a result, if it is necessary to change the amount of ink droplet to be squirted depending on the physical properties of the ink, it is possible to change the amount of ink droplet to be squirted by setting the heating area. At this time, the aspect ratio of the heating area is increased with the smaller heating area, which makes it possible to render the amount of supplied energy per unit area equal. Like the ink-jet recorder as defined in the fifth aspect of the present invention, the heating resistor which squirts a different amount of ink droplet can be actuated under substantially the same electrical conditions. Particularly, like the ink-jet generating resistor as defined in the sixth aspect of the present invention, the nozzle can be actuated on substantially the same voltage and with substantially the same pulse width.

The above-described configuration, in which the bubble-generating area is set according to color and concentration, can be applied to the ink-jet recorder comprising the plurality of ink-jet heads each of which includes the nozzle for colors or concentrations, as defined in the third aspect of the present invention.

Alternatively, the above-described configuration can be applied to the ink-jet recorder, as defined in the fourth aspect of the present invention, which comprises one ink-jet recording head including the nozzle for colors or concentrations.

The above and other objects and features of the present invention will be more apparent from the following description taken in conjunction with the accompanying drawings.

BRIEF DESCRIPTION OF THE DRAWINGS

FIG. 6 is a table related to a specific example of the physical properties of the ink used in the embodiment and the required amounts of ink droplet;

FIG. 7 is a table related to a specific example of the amounts of ink droplet discharged by a conventional ink-jet head;

FIG. 8 is a table related to a specific example in which the bubble forming area is changed;

FIG. 9 is a table related to a specific example in which the amount of actually squirted ink droplet after the bubble forming area has been set;

FIG. 10 is a table related to a specific example in which the area and aspect ratio of the heating area are changed;

FIGS. 11A and 11B are front views of the ink-jet head according to a second embodiment of the ink-jet recorder of the present invention;

FIG. 12 is a table related to a specific example of the heating area of the heating resistor and the sheet resistance;

FIGS. 14A to 14C show one example of a conventional thermal ink-jet head, wherein FIG. 14A is a cross-sectional view of the thermal ink-jet head which is taken in the axial direction of a flow path, FIG. 14B is a plan view of the thermal ink-jet head taken along line B—B shown in FIG. 14A; and FIG. 14C is a front view of the thermal ink-jet head as viewed from a nozzle;

DETAILED DESCRIPTION OF THE PREFERRED EMBODIMENTS

Now, a description will be given in more detail of embodiments of the present invention with reference to the accompanying drawings.

Figure 1A:
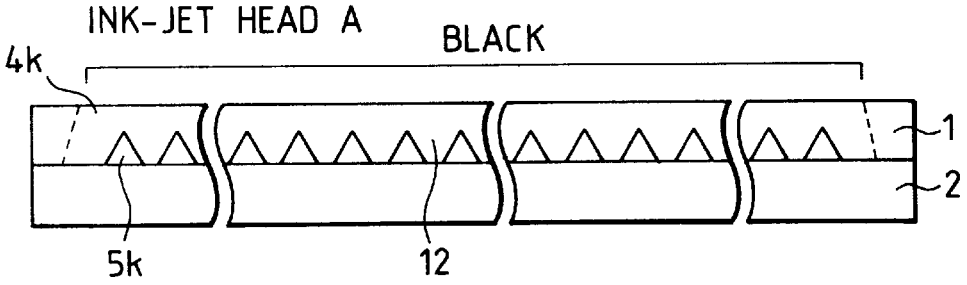
FIGS. 1A and 1B are front views of one example of an ink-jet recording head according to a first embodiment of the present invention.
Figure 1B:
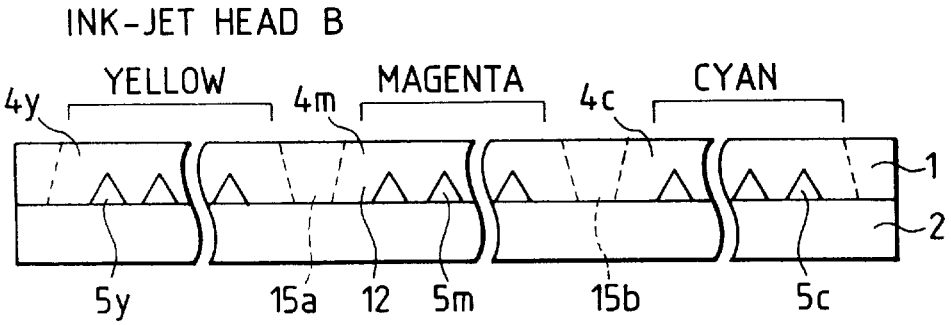
Figure 2:
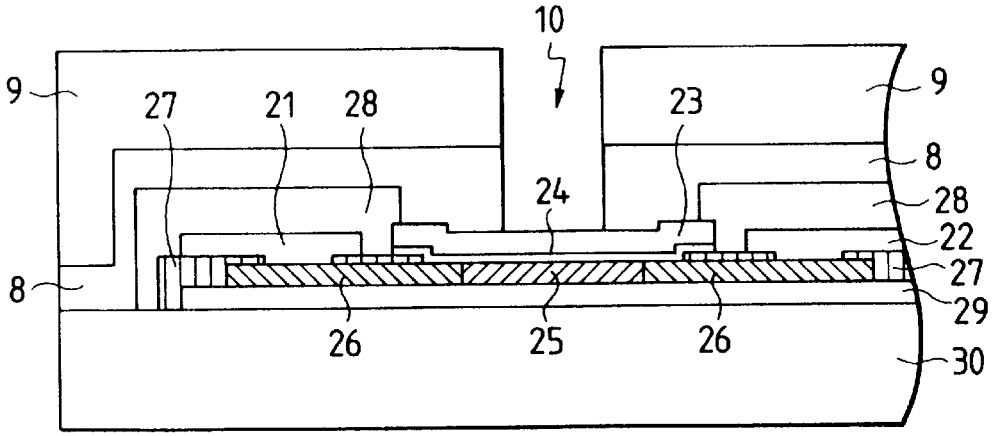
FIG. 2 is a cross-sectional view of one example of a surrounding area of a heating resistor of the ink-jet recording head according to the first embodiment.
Figure 3:
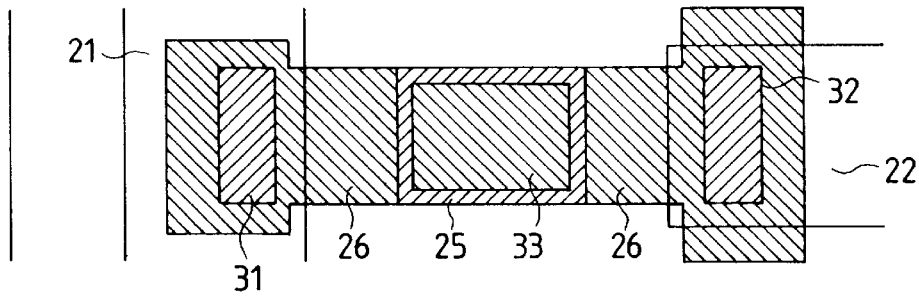
FIG. 3 is a schematic plan view of the surrounding area of the heating resistor according to the first embodiment of the present invention.
Figure 14A:
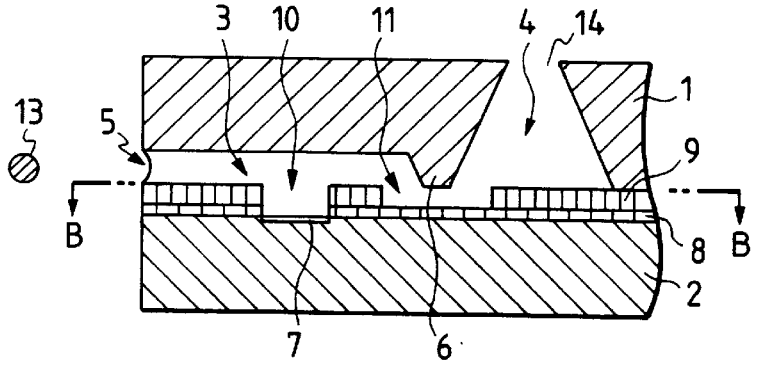
FIG. 14A Prior Art
Figure 14B:
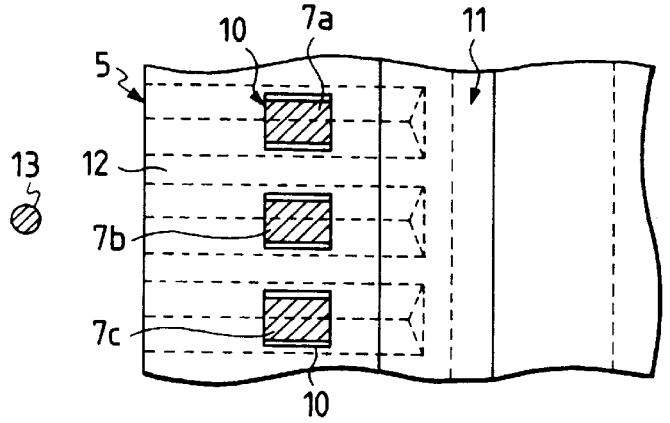
FIG. 14B Prior Art
Figure 14C:
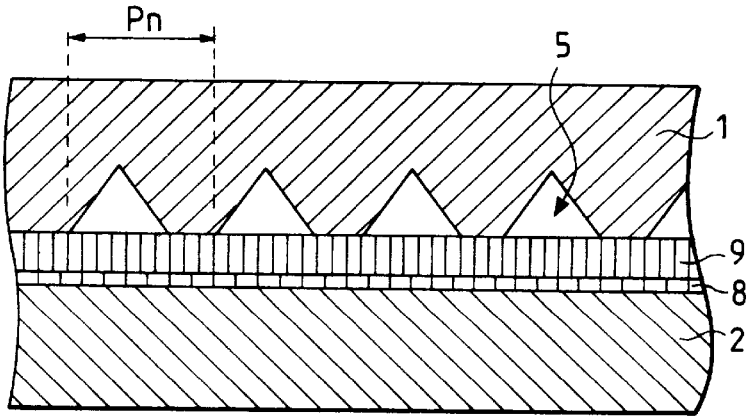
FIG. 14C Prior Art
Figure 15:
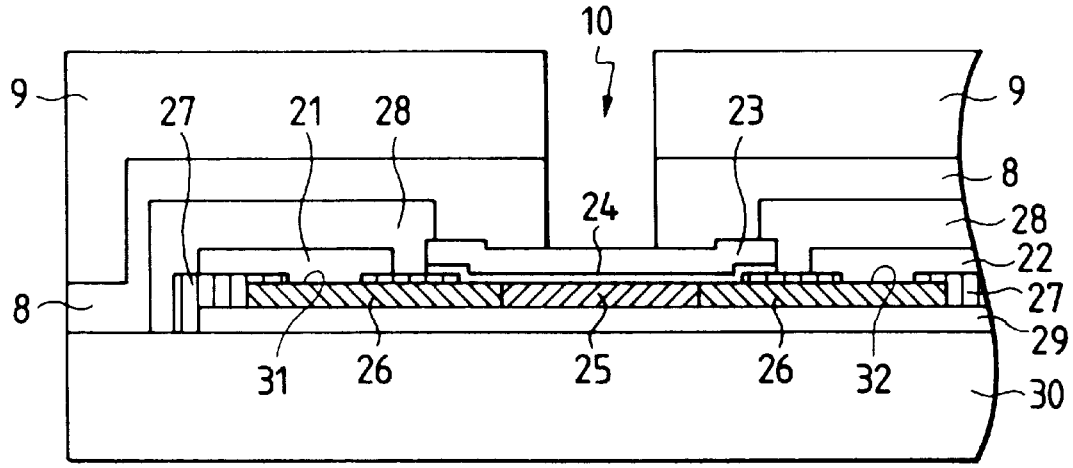
FIG. 15 Prior Art
FIG. 15 is a detailed cross-sectional view of a surrounding area of a heating resistor of one example of the conventional ink-jet recording head.
Figure 16:
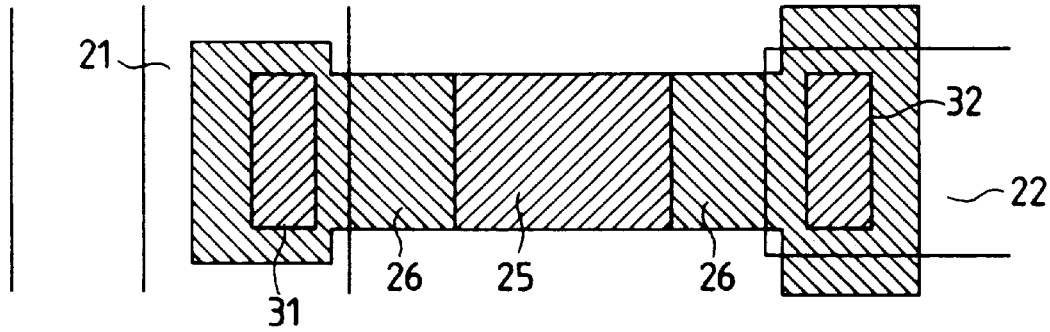
FIG. 16 Prior Art
FIG. 16 is a plan view of the surrounding area of the heating resistor of one example of the conventional ink-jet recording head.

FIGS. 1A and 1B are front views of one example of an ink-jet recording head according to a first embodiment of the present invention, FIG. 2 is a cross-sectional view of one example of a surrounding area of a heating resistor of the ink-jet recording head shown in FIG. 1, and FIG. 3 is a schematic plan view of the surrounding area of the heating resistor shown in FIG. 2. In the drawings, the same elements as those shown in FIGS. 14 to 16 are assigned the same reference numerals, and their explanations will be omitted here. Reference numerals 4*c*, 4*m*, 4*y*, and 4*k* designate a common liquid chamber for cyan, a common liquid chamber of magenta, a common liquid chamber for yellow, and a common liquid chamber for black, respectively. Reference numerals 5*c*, 5*m*, 5*y*, and 5*k* designate a nozzle for cyan, a nozzle for magenta, a nozzle for yellow, and a nozzle for black, respectively. Reference numerals 15*a* and 15*b* designate inter-color partitions, and reference numeral 33 designates a bubble forming area.

An ink-jet recorder of the present embodiment which will now be described has two ink-jet heads. One of the two ink-jet heads is an ink jet-head A for squirting black ink, as shown in FIG. 1A. Nozzles 5*k* arrayed in the ink-jet head A are all used for squirting black ink. For example, the ink-jet head A may be arranged such that 256 nozzles are arrayed with pitches (Pn=84.5 $\mu$m) which correspond to a resolution of 300 spi.

The other ink-jet head is an ink-jet head B for squirting ink of the primary colors, i.e., yellow, magenta, and cyan. FIG. 1B shows the ink-jet head B which is divided into three subdivisions so as to respectively correspond to the primary colors. For example, each of the primary colors is assigned 84 nozzles. In this case, the nozzles in each color section can be arrayed with pitches which correspond to a resolution of, e.g., 300 spi, in the same manner as the nozzles of the ink-jet head A. The inter-color partitions 15*a* and 15*b* are provided so as to separate the colors from each other. No nozzles are provided at these inter-color partitions. Alternatively, nozzles which do not squirt ink are provided in these inter-color partitions, whereby a mixture of adjacent colors of ink is prevented. The ink-jet head of this type which comprises a plurality of colors in an integrated manner is disclosed in, e.g., Unexamined Japanese Patent Application No. Hei-7(1995)-1267.

Color recording becomes feasible as a result of the discharge of ink having four colors, i.e., black, yellow, magenta, and cyan, from these two ink-jet heads A and B. Since a black print can be formed using only ink of yellow, magenta, and cyan, the color recording is also feasible without the use of the ink-jet head A. In that case, the color developing characteristics of black ink drop. Allowing for an improvement in the color developing characteristics of the black ink and the realities in which a printing operation using only the black ink is carried out many times, the ink-jet recorder is provided with the ink-jet head A. Alternatively, one ink-jet head may be divided into four subdivisions so as to be assigned to four colors, that is, yellow, magenta, cyan, and black, respectively. Colors of the ink to be used are arbitrarily determined, and ink having different concentrations may also be used.

The channel of each nozzle has the same longitudinal cross section as, for example, that of the channel shown in FIG. 14. The channels can be manufactured using the same technique as that is used for manufacturing a conventional ink-jet head such as an ink-jet recording head as disclosed in Unexamined Japanese Patent Application No. Hei-5(1993)-155020.

Ink having composition as disclosed in, for example, Unexamined Japanese Patent Application Nos. Hei-4 (1992)-325574, Hei-5(1993)-140496, and Hei-6(1994)-58356, can be used as the ink to be used in each of the ink-jet heads. In general, there is a suitable amount of ink droplet for ink of each color depending on the physical properties of that ink. For example, if the viscosity of the ink is high, a sufficient amount of ink droplet may not be squirted. Further, if the color developing characteristics of the ink of one color are superior to those of the ink of the other colors, a color balance may be deteriorated. If the ink of different colors is discharged under the same conditions as it has been practiced in the art, the amount of ink droplet of each color does not become a suitable value. Hence, an improvement in the image quality cannot be expected. Although the amount of ink droplet can be varied by changing the electrical conditions of the drive pulse, it is not desirable for reasons as previously described.

One method of changing the amount of ink droplet without varying the drive pulse conditions is that the ink-jet head is arranged so as to prevent some of the heating value generated in the heating area 25 of the heating resistor from being used in generating a bubble. In short, the first indentation 10 formed on the heating area 25 is made smaller than the heating area 25 by use of the insulating layer 8 and the thick-film insulating layer 9, as shown in FIGS. 2 and 3. As a result, some of the heat generated in the heating area 25 which corresponds to the area of the first indentation 10 in the bubble forming area 33 contributes to the formation of a bubble. Therefore, it is possible to control the amount of ink droplet by regulating the size of the bubble forming area 33.

Figure 4:
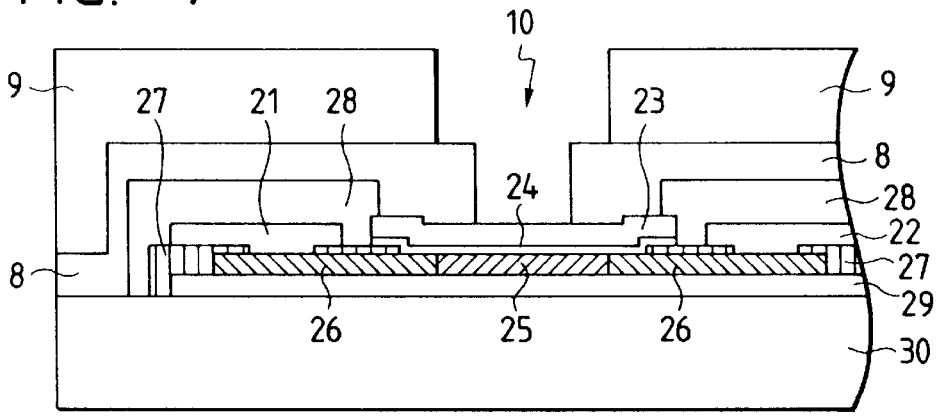
FIG. 4 is a cross-sectional view of another example of the surrounding area of the heating resistor of the ink-jet recording head according to the first embodiment of the present invention.
Figure 5:
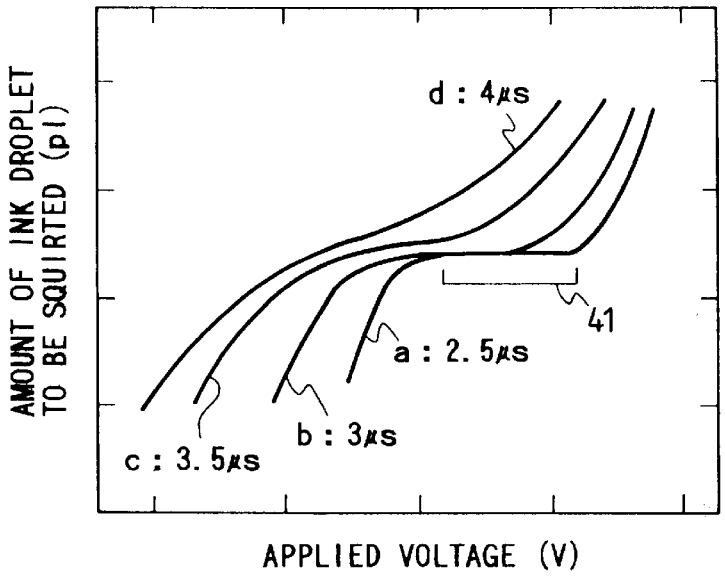
FIG. 5 is a plot showing the relationship between a voltage applied to the heating resistor and the amount of ink droplet when the pulse width of the applied voltage is changed.

FIG. 4 is a cross-sectional view of another example of the surrounding area of the heating resistor of the ink-jet recording head according to the first embodiment of the present invention. In the drawings, the reference numerals are provided to designate the same elements as those shown in FIG. 2. In the example shown in FIG. 2, the size of the bubble forming area 33 is defined by use of the insulating layer 8 and the thick-film insulating layer 9. However, the method of defining the size of the bubble forming area 33 is not limited to the above described method. For example, the size of the bubble forming area 33 may be defined by use of only the insulating layer 8, as shown in FIG. 4. Alternatively, the size of the bubble forming area 33 may be defined by forming another film having low heat conductivity, and by pattering that film.

With reference to specific embodiments, the present invention will be described hereinbelow. FIG. 6 is a table related to a specific example of the physical properties of the ink used in the embodiment and the required amounts of ink droplet. FIG. 6 shows examples of the viscosity and surface tension of the ink at a temperature of 25° C. and the suitable amount of ink droplet with regard to each of the four colors, i.e., black, yellow, magenta, and cyan. In order to increase the concentration of resultant color ink, and to cope with the reality that the black ink is solely used in many cases, the suitable amount of black ink droplet is set so as to be larger than the amounts of ink droplet of the other colors. A plurality of colors are reproduced by mixing together the other colors, i.e., yellow, magenta, and cyan, and hence the suitable amounts of ink droplet of the colors are set so as to be smaller than the suitable amount of ink droplet of black. The suitable amounts of ink droplet of these three colors differ from each other for reasons of their physical properties. Also, in order to form black consisting of yellow, magenta and cyan, which is so-called process black, the amount of ink for each color is adjusted to an optimum value. Furthermore, the amount of ink droplet for each color is so set as to obtain an optimum ratio of those three colors for making next color, and the amount of ink droplet for each color may be changed by the penetrating rate of ink, the surface tension, the viscosity or the like.

FIG. 7 is a table related to a specific example of the amounts of ink droplet discharged by a conventional ink-jet head. As with the conventional ink-jet head, the size of the heating area and the size of the bubble forming area of all the heating resistors of the ink-jet heads A and B are set so as to be the same as the sizes shown in FIG. 7. In this case, the suitable amount of black ink droplet is larger than the amounts of ink droplet of the other colors, and hence the width of the channel 3 for black ink, i.e., the length of the bottom of a triangular nozzle for black ink, is changed. These ink-jet heads A and B are actuated by the drive pulse on a voltage of 3.7 V using a pulse width of 3 $\mu$s. FIG. 7 shows the amount of ink in the practically discharged ink droplet and the speed of squirt of the ink when it was discharged.

The channel width of the ink-jet head for black ink is set large, and hence the suitable amount of ink droplet as shown in FIG. 7 was eventually obtained. For the ink of the other colors, substantially the same amount of ink droplet as the amount of black ink droplet was obtained, and hence the suitable amounts of ink droplet as shown in FIG. 6 were not obtained.

For the ink of the colors other than black, it is possible to control the amount of ink droplet so as to become close to a desired level by controlling the channel width. However, the control of the amount of ink droplet by adjustment of the channel width is not desirable in view of the following respects. Specifically, if the channel width is set so as to become too small, the partition 12 shown in FIG. 14 becomes large. The bond area where the two substrates are bonded together becomes large, and hence the leak of an excessive adhesive into the channel becomes large, which in turn deteriorates the directionality of discharge of the channel.

On the assumption that the size of the heating resistor is the same, and that the size and pressure of a resultantly formed bubble are the same, the speed of the ink droplet squirted from the nozzle becomes faster as the channel width, i.e., the nozzle width, becomes smaller although it is further affected by the physical properties and compositions of the ink. As shown in FIG. 7, the speed of the ink droplets of other than black which is squirted from the channel having a smaller width is faster than the speed of the black ink droplet. If the speed of ink droplet to be squirted varies with colors, the positions at which the ink droplets arrive become different in the direction in which a carriage travels back and forth, in the case where a printing operation is carried out by travel of the carriage. For these reasons, if the channel width is made too small, the quality of an image becomes deteriorated when the printing operation is carried out by the to-and-fro movement of the carriage.

As described above, it is not desirable to reduce the nozzle width in order to reduce the amount of ink droplet to be squirted. Therefore, it is possible to reduce the amount of ink to be squirted by reducing, e.g., the bubble forming area 33, so as to become smaller than the heating area in the manner as previously described. FIG. 8 is a table related to a specific example in which the bubble forming area is changed. As shown in FIG. 7, in the case where the bubble forming area is the same as the heat generating area, the amounts of yellow and magenta ink droplet to be squirted are larger than the suitable amounts of yellow and magenta ink droplet as shown in FIG. 6. Further, the speeds of squirt of yellow and magenta ink are faster than that of black ink. For these reasons, the channel width is increased so as to make the speeds of the squirt of the ink uniform, whereby the quality of an image is improved. Although the amount of ink droplet to be squirted further increases as a result of an increase in the channel width, the area of the bubble forming area is set in consideration of a resultantly increased amount of ink droplet. For cyan, the amount of ink droplet to be squirted is smaller than the suitable amount of ink droplet shown in FIG. 7. However, the speed of squirt of cyan ink is faster than that of black ink. Therefore, the channel width is increased, and the area of the bubble forming region is set in consideration of a resultantly increased amount of ink droplet. In FIG. 8, the width of the bubble forming area is set so as to become narrower than the width of the heating area, whereby the bubble forming area is made smaller than the heating area. In this case, the bubble forming area is defined by the size of the first indentation 10 formed by the insulating layer 8 and the thick-film insulating layer 9.

FIG. 9 is a table related to a specific example in which the amount of actually squirted ink droplet after the bubble forming area has been set. As shown in FIG. 9, the suitable amount of ink droplet of each color is squirted as a result of the bubble forming area being set in the way as shown in FIG. 8. Further, substantially the same speed of squirt of ink could be achieved.

In this case, if the voltage and width of the pulse which drives the heating resistor are the same, the energy per unit area becomes equal for each color, and the electrical conditions remain unchanged, because the size of the heating area is the same for each color. In short, the suitable amount of ink droplet could be obtained for each color.

Another method of changing the amount of ink droplet without varying the drive pulse conditions will now be described. On the assumption that all of the energy supplied to the heating resistor is E, the area of the heating region is S, the voltage of the drive pulse is V, the pulse width is "t", the sheet resistance of the heating area of the heating resistor is $R_S$, the length of the heating area in the direction of flow of an electric current "1", and the width of the heating area in the direction perpendicular to the direction of the flow of the current is "w", the amount of energy ΔE per unit area of the heating resistor is given by $$\Delta E = E/S = ((V^2/R)\cdot t)/(\Omega\cdot l) = ((V^2/(R_S\cdot l/\Omega)\cdot t)/(\Omega\cdot l) = (V^2\cdot t)/(R_S l^2).$$

The amount of energy ΔE per unit area of the heating area is dependent on the length "1" of the heating area and the sheet resistance $R_S$ of the heating area of the polycrystalline silicon layer used as the heating resistor in addition to the voltage V and the pulse width "t" of the voltage pulse conditions. As previously described, if, e.g., the amount of energy ΔE per unit area, is large, the deterioration of the heating resistor is considerable. Conversely, if the amount of energy ΔE per unit area is small, the generation of a bubble is affected. For these reasons, it is desirable that the heating resistors should have substantially the same amount of energy ΔE per unit area.

From the previously described equation, in order to assure the same amount of energy ΔE per unit area by application of the drive pulse having the identical voltage V and pulse width "t" to the heating resistors having different areas, it is only necessary to make the lengths of the heating areas in the direction of a flow path equal to each other, provided that the heating resistors have the same sheet resistance. Further, it is possible to assure the constant amount of energy ΔE per unit area by changing the length "1" and the resistance $R_S$.

To begin with, an explanation will be given of the case where the heating resistors have the same sheet resistance. In this case, it is only necessary to change the area of the heating region while the lengths of the heating areas are maintained so as to be identical with each other, in order to assure the same amount of energy ΔE per unit area. In short, it is only necessary to change the widths of the heating areas. Provided that the length of the heating area in the direction of a flow path is L, and that the width of the heating area in the direction in which the channels are arranged is W, a value defined by L/W is called an aspect ratio. The aspect ratio changes by varying the width of the heating area. The smaller the area of the heating area, the width W of the heating area becomes wider, and hence the aspect ratio becomes larger.

If the aspect ratio is made larger by reducing the area of the heating area, the amount of heat generated by the overall heating areas becomes small, because the amount of energy ΔE per unit area is maintained at substantially the same level. Therefore, the amount of ink droplet to be squirted becomes reduced.

FIG. 10 is a table related to a specific example in which the area and aspect ratio of the heating area are changed. In this example, the ink, which has such physical properties and suitable amounts of ink droplet as shown in FIG. 6, is used. For the colors other than black, the heating area has a larger aspect ratio by reducing the width and area of the same when compared with the aspect ratio of the heating area of the conventional ink-jet head shown in FIG. 7, as shown in FIG. 10. As a result, the amount of ink droplet is reduced.

In practice, a heat distribution in the heating area, conditions of thermal diffusion in the direction of a plane, and the resistance of a low-resistance area which is made of a polycrystalline silicon layer and extends to the common electrode and the individual electrode, become different depending on the shape of the heating resistor. Hence, it is impossible to render the lengths of the heating areas completely equal to each other. As previously described, in order to render the properties other than the amount of ink droplet, such as the speed of the squirt of the ink droplet, equal to each other with regard to all of the colors, the flow path parameters regarding the areas other than the heating area may be further changed. The influence of these changes must be taken into account when the size and shape of the heating area are determined. FIG. 10 shows the area of the heating region, the aspect ratio, and the channel width which are determined so as to correspond to each color in consideration of the above-described influence. FIG. 10 shows the energy per unit area which is shown in relative values based on the assumption that the energy of black ink per unit area is one. The amount of ink droplet to be squirted and the speed of squirt of the ink as shown in FIG. 9 can be obtained by setting the area, the aspect ratio, and the channel width of the heating area so as to correspond to each color as shown in FIG. 10. In this way, the amount of ink droplet to be squirted becomes an appropriate value, and substantially the same speed of the ink droplet to be squirted is obtained for each ink.

The heating area is longitudinally defined by changing the area to be masked during the course of ion implantation for forming a low-resistance area in the polycrystalline silicon layer. Further, the heating area can be transversely defined by changing the width of the polycrystalline silicon layer.

The case where the length "1" and sheet resistance $R_S$ of the heating resistor are changed under the same conditions of the drive pulse to be applied will now be described. It is difficult to manufacture the heating resistors which are different from each other in sheet resistance $R_S$ on the same Si wafer in terms of the manufacturing process. Consequently, it is difficult to change both the length and the sheet resistance of the heating resistor in the case where ink of three different colors is squirted from one head, and where the heating area is changed in order to change the amount of ink droplet to be squirted, as shown in FIG. 1B. Therefore, the change of the length and sheet resistance of the heating resistor will be described with reference to a second embodiment shown below.

FIGS. 11A and 11B are front views of the ink-jet head of the ink-jet recorder according to a second embodiment of the present invention. In the drawings, the same elements as those shown in FIGS. 1A and 1B are assigned the same reference numerals. Reference numerals $4k_1$, $4k_2$ are common liquid chambers, and $5k_1$, $5k_2$ are nozzles. In this embodiment, the ink-jet head A squirts black ink $k_1$ having a high concentration, and an ink-jet head B squirts black $k_2$ having a low concentration. The use of ink having different concentrations makes it possible to extend the range of reproducibility of gradations. These two types of ink are squirted from the ink-jet heads A and C, respectively. Each ink is squirted using all of the nozzles in the ink-jet heads.

As described above, even in such an arrangement that each ink is squirted from an individual ink-jet head, it is possible to obtain a suitable amount of ink droplet by changing the bubble forming area or the area and aspect ratio of the heating area. This arrangement is the same as the arrangement of the first embodiment, and hence it's explanation will be omitted here.

With reference a specific embodiment, an explanation will be given of the case where a suitable amount of ink droplet is obtained by changing the length "1" and the sheet resistance $R_S$ of the heating resistor while the same amount of energy per unit area is maintained. In this example, a suitable amount of ink droplet with regard to the dark black ink $k_1$ is set to 90 pl as shown in FIG. 6, and a suitable amount of ink droplet with regard to the light-black ink $k_2$ is set to 60 pl.

FIG. 12 is a table related to a specific example of the heating area of the heating resistor and the sheet resistance. For comparison, the length "1" of the heating area is changed while the aspect ratio of the heating area is maintained. In this example, the length of the heating area for the light black ink $k_2$ is made shorter than the length of the heating area for the dark black ink $k_1$.

Further, the sheet resistance of the heating resistors is determined such that the amount of energy per unit area becomes constant. In this event, the sheet resistance of the polycrystalline silicon layer for the dark black ink $k_1$ which requires a large heating area is set to 45 Ω/□, and the sheet resistance of the polycrystalline silicon layer for the light black ink $k_2$ which requires a small heating area is set to 51 Ω/□. In this example, P ions are implanted as impurities into the polycrystalline layer having a sheet resistance of 45 μ/□ at a rate of $6.75\times10^{15}$ ions/cm$^2$, and the P ions are implanted as impurities into the polycrystalline layer having a sheet resistance of 51 Ω/□ at a rate of $6.19\times10^{15}$ ions/cm$^2$. As ions are implanted into the low-resistance areas which respectively connect the heating area to the common electrode and the individual electrode at a rate of $4.3\times10^{15}$ ions/cm$^2$. As a result, the polycrystalline layers of the heating areas have sheet resistance of 32.3 Ω/□ and 34.2 Ω/□, respectively. If the sheet resistance is adjusted in this way, it is possible to render the amount of energy per unit area equal using the same voltage pulse, as it is evident from the above-described equation.

It is possible to obtain a suitable amount of ink droplet by setting the sheet resistance and the length of the heating area of the ink-jet heads A and C in the manner as shown in FIG. 12. At this time, the two heads may be provided with the drive pulse having the same voltage and pulse width, which makes it possible for the two heads to share the power supply and the drive circuit with one another. In the example shown in FIG. 12, the channel width is slightly changed, and an increase or a reduction in the amount of ink droplet corresponding to that slight change has also been taken into account.

It is necessary to change the amount of impurity ions to be implanted for each of the ink-jet heads A and C, in order to change the sheet resistance. To this end, it is necessary to separate the manufacturing processes for each of the ink-jet heads A and C. However, it is only necessary to manufacture the ink-jet heads A and C on the separate Si wafers, respectively, such that the processes of the ink-jet heads are separated from each other.

Although the sheet resistance of the heating resistor has been changed by controlling the amount of ions to be implanted, it is also possible to change the sheet resistance by changing the thickness of the polycrystalline silicon layer which acts as the heating resistor. In this case, for example, if the thickness of the polycrystalline silicon layer of the heating resistor 5, shown in FIG. 12, is reduced to about 88% of the thickness of the heating resistor 1 while the amount of P ions to be implanted is maintained at a rate of $6.75\times10^{15}$ ions/cm$^2$, a desirable sheet resistance value is obtained. More specifically, it is only necessary to set the thickness of the heating resistor 1 to 1.20 μm, as well as setting the thickness of the heating resistor 5 to 1.06 μm. However, this manufacturing method which requires the change of the thickness of the heating resistor imposes a somewhat larger load on the manufacturing process when compared with the method which requires the change of the amount of ions to be implanted.

Although the second embodiment shows that each of the two types of ink having different concentrations uses an individual ink-jet head, it may be possible for each of more than three types of ink to use an individual ink-jet head. Further, it is possible to use an individual ink-jet head for each color in such a case of the use of ink having several colors as described in the first embodiment. If the ink-jet recorder uses three colors, e.g., yellow, magenta, and cyan, three ink-jet heads are used. Similarly, if four colors, that is, black in addition to yellow, magenta, and cyan, are used, four ink-jet heads are used. Further, it may be possible to arrange the ink-jet recorder to use more than five types of ink having different concentrations. As a matter of course, the color and concentration of the ink to be used in the first and second embodiments are optional, and hence the present invention is not limited to the these embodiments.

Figure 13A:
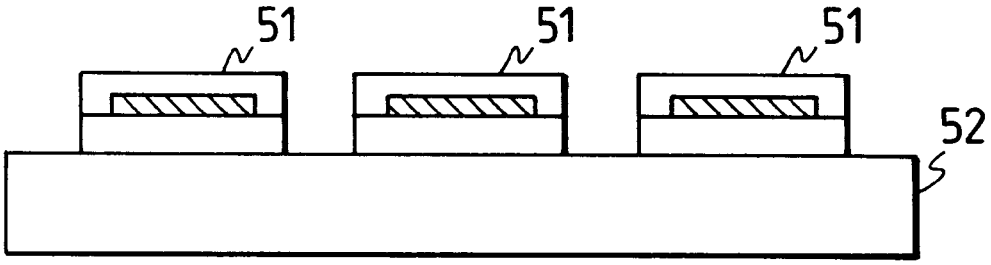
FIGS. 13A and 13B are schematic representations showing the exemplary layout of a plurality of ink-jet heads.
Figure 13B:
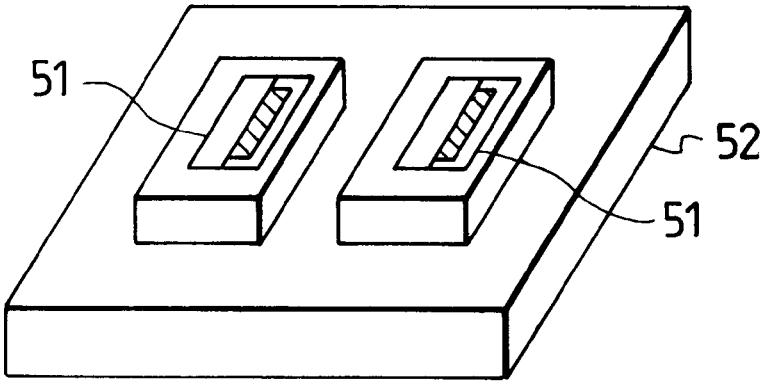

FIGS. 13A and 13B are schematic representations showing the exemplary layout of a plurality of ink-jet heads. In the drawings, reference numeral 51 is an ink-jet head, and 52 is a carriage. When the plurality of ink-jet heads 51 are mounted on, e.g., the carriage 52, they are arranged in such a way as shown in FIGS. 13A and 13B. The layout of the ink-jet heads shown in FIG. 13A is the same as the ink-jet heads disclosed in, e.g., Unexamined Japanese Patent Publn. No. Hei-5(1993)-185608. The plurality of ink-jet heads 51 are arranged in the direction in which the nozzles of the ink-jet heads are arranged. This type of configuration is implemented by one ink-jet head, e.g., an ink-jet head comprising heads for a plurality of colors in an integrated manner, as shown in FIG. 1B.

As shown in FIG. 13B, the plurality of ink-jet heads 51 may be arranged in the direction orthogonal to the direction in which the nozzles of the ink-jet heads are arranged. For example, the ink-jet head A shown in FIG. 1A and the ink-jet head B shown in FIG. 1B may be arranged in the manner as shown in FIG. 13B.

As described in the first and second embodiments, in order to obtain the optimum amount of ink droplet for each color or concentration using the same drive pulse, the size of the bubble forming area, the area and aspect ratio of the heating area, and the length and sheet resistance of the heating area are changed for each color or concentration. As previously described, each of these changes contributes to the setting of the amount of ink droplet. It may be possible to arrange the ink-jet heads so that the optimum amount of ink droplet can be obtained by combination of these changes. For example, in the case of the ink-jet head B as described in the first embodiment, it is possible to obtain the suitable amount of ink droplet corresponding to the physical properties of the ink to be used by adjusting the size of the bubble forming area as well as the area and aspect ratio of the heating region. Moreover, in the case of the combination of different heads like the ink-jet heads A and C as described in the second embodiment and the ink-jet heads A and B as described in the first embodiment, it is possible to arrange the ink-jet heads such that the suitable amount of ink droplet is obtained by adjusting the length and sheet resistance of the heating area in addition to the above described adjustments. As a matter of course, the suitable amount of ink droplet can be obtained by another combination of the adjustments. As previously described, it becomes possible to improve the quality of an image to a much greater extent by carrying out a setting operation in consideration of the characteristics other than the speed of the squirt of the ink droplet and the amount of ink droplet.

As is evident from the foregoing descriptions, according to the present invention, the heating area of the heating resistor is changed for each color or concentration in the ink-jet head which squirts ink droplets having different colors or concentrations. Hence, the amount of ink droplet to be squirted can be set to an optimum value for each color or concentration. As a result, the quality of an image can be improved. At this time, with the smaller heating area, the resistance of the heating area is increased by increasing the sheet resistance of the heating area. In consequence, substantially the same energy per unit area of the heating area can be obtained. Therefore, even if the amounts of ink droplet to be squirted are different, the ink-jet nozzle can be actuated by use of the common voltage pulse, which in turn eliminates the need of use of a plurality of power supplies and renders the drive circuit simple. As a result, it becomes possible to prevent an increase in size and cost of the recorder.

Alternatively, with the smaller heating area, the aspect ratio of the heating area is increased. In consequence, substantially the same energy per unit area of the heating area can be obtained. Therefore, even if the amounts of ink droplet to be squirted are different, the ink-jet nozzle can be actuated by use of the common voltage pulse, which in turn eliminates the need of use of a plurality of power supplies and renders the drive circuit simple. As a result, it becomes possible to prevent an increase in size and cost of the recorder.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink-jet recorder that prints using a plurality of ink colors of concentrations, comprising:

a plurality of nozzles, at least one of the plurality of nozzles being provided for each of the plurality of ink colors or concentrations from which an ink droplet is squirted;

a plurality of heating resistors, one provided adjacent each of said plurality of nozzles and each having a heating surface area for generating a heat that allows the ink droplet to be squirted from said plurality of nozzles, the heating surface area of each said heating resistor being substantially the same; and drive means for actuating said plurality of nozzles, the drive means actuating said plurality of nozzles on substantially the same voltage and with substantially the same pulse width, wherein a bubble forming surface area of each of said heating resistors is sized for a particular one of the plurality of colors or concentrations, a first bubble forming surface area corresponding to a first color or concentration being set to a first surface area and a second bubble forming surface area smaller than the first bubble forming surface area corresponding to a second color or concentration being set to a second surface area, said first bubble forming surface area and said second bubble forming surface area being defined by a coating low in heat conductivity disposed on at least a predetermined portion of said heating surface area of each said heating resistor.

2. An ink-jet recorder according to claim 1, wherein said plurality of nozzles are disposed in a plurality of ink-jet recording heads.

3. An ink-jet recorder according to claim 1, wherein said plurality of nozzles are disposed in one ink-jet recording head.

4. An ink-jet recorder according to claim 1, wherein said coating is an insulating layer.

5. An ink-jet recorder according to claim 1, wherein each of said nozzles has a channel a width of which is changed according to each color or each concentration to make a speed of squirt of ink uniform.

6. An ink-jet recorder that prints using a plurality of ink colors or concentrations, comprising:

a plurality of nozzles, at least one of the plurality of nozzles being provided for each of the plurality of ink colors or concentrations from which an ink droplet is squirted, each of said plurality of nozzles having a channel of a predetermined width;

a plurality of heatings resistors, one provided adjacent each of said plurality of nozzles and each having a heating surface area corresponding to each color or concentration for generating a heat that allows the ink droplet to be squirted from said plurality of nozzles; and drive means for actuating said plurality of nozzles, said drive means actuating said plurality of nozzles on substantially the same voltage and with substantially the same pulse width, wherein an aspect ratio AR=LfW of the heating surface area is increased with a smaller heating surface area, a length of the heating surface area of said heating resistor in a direction of a flow path is L, and a width of the heating surface area of the heating resistor in a direction in which multiple ones of said plurality of heating resistors are arranged is W, said aspect ratio being selected so that each heating resistor has substantially the same amount of energy $\Delta E$ per unit area, and said channel width of each of said plurality of nozzles being changed according to each color or concentration to make an ink squirting speed uniform.

7. An ink-jet recorder according to claim 6, wherein said plurality of nozzles are disposed in a plurality of ink-jet recording heads.

8. An ink-jet recorder according to claim 6, wherein said plurality of nozzles are disposed in one ink-jet recording head.

9. An ink-jet recorder according to claim 6, wherein said heating surface area has a constant length and a reduced width to increase the aspect ratio.

10. An ink-jet recorder that prints using a plurality of ink colors or concentrations, comprising:

a plurality of nozzles, at least one of the plurality of nozzles being provided for each of the plurality of ink colors or concentrations from which an ink droplet is squirted, each of said plurality of nozzles having a channel of a predetermined width;

a plurality of heating resistors, one provided adjacent each of said plurality of nozzles, each of said heating resistors having a heating surface area corresponding to a particular one of the plurality of colors or concentrations for generating a heat that allows the ink droplet to be squirted from a corresponding one of said plurality of nozzles, a resistance of the heating surface area of said heating resistors being increased with a smaller surface heating area so that each of said heating resistors has substantially the same amount of energy $\Delta E$ per unit area; and drive means for actuating said plurality of nozzles, said drive means actuating said plurality of nozzles on substantially the same voltage and with substantially the same pulse width, wherein said channel width of each of said plurality of nozzles is changed according to each color or concentration to make an ink squirting speed uniform.

11. An ink-jet recorder according to claim 10, wherein said plurality of nozzles are disposed in a plurality of ink-jet recording heads.

12. An ink-jet recorder according to claim 10, wherein said plurality of nozzles are disposed in one ink-jet recording head.

13. An ink-jet recorder according to claim 10, wherein a length of the heating surface area for a light black ink is set to be shorter than that for a dark black ink.

14. An ink-jet recorder according to claim 10, wherein ions are implanted as impurities to increase a sheet resistance.

15. An ink-jet recorder according to claim 10, wherein a sheet resistance is changed by changing a thickness of the heating resistor.

* * * * *